United States Patent [19]

Lavochkin et al.

[11] 4,187,711

[45] Feb. 12, 1980

[54] METHOD AND APPARATUS FOR PRODUCING A HIGH FIN DENSITY EXTRUDED HEAT DISSIPATOR

[75] Inventors: Ronald B. Lavochkin, Newton; Thomas D. Coe, Boxford, both of Mass.

[73] Assignee: Wakefield Engineering, Inc., Wakefield, Mass.

[21] Appl. No.: 927,206

[22] Filed: Jul. 24, 1978

Related U.S. Application Data

[63] Continuation-in-part of Ser. No. 790,621, Apr. 25, 1977, abandoned.

[51] Int. Cl.[2] ..... B21C 23/14; B21C 25/02; B21D 3/00; B21D 25/04

[52] U.S. Cl. ..... 72/256; 72/253 R; 72/183; 72/302; 72/378; 72/303; 72/467; 72/702; 29/DIG. 47

[58] Field of Search ..... 72/253, 256, 260, 183, 72/298, 302, 303, 311, 371, 702, 378, 406, 151, 160, 166, 169, 177, 467; 29/DIG. 47, 155 R, 157.3 A, 157.3 R

[56] References Cited

U.S. PATENT DOCUMENTS

| | | | |
|---|---|---|---|
| 437,703 | 10/1890 | Loomis | 72/183 |
| 809,664 | 1/1906 | Bergmann | 72/183 |
| 918,121 | 4/1909 | Brashear | 72/183 |
| 1,423,361 | 7/1922 | Rockwell | 72/256 |
| 2,458,686 | 1/1949 | Davie, Jr. | 29/DIG. 47 |
| 2,681,734 | 6/1954 | Braeuninger | 72/256 |
| 2,692,421 | 10/1954 | Cozzo | 29/DIG. 47 |
| 2,716,805 | 9/1955 | Reed | 29/DIG. 47 |
| 2,742,692 | 4/1956 | Braeuninger | 72/256 |
| 2,767,767 | 10/1956 | Peterson | 72/256 |
| 2,798,286 | 7/1957 | Anderson | 72/256 |
| 2,852,062 | 9/1958 | Lorant | 72/302 |
| 2,872,037 | 2/1959 | Ansel et al. | 72/256 |
| 2,936,018 | 5/1960 | De Ridder et al. | 72/389 |
| 3,051,217 | 8/1962 | Hill et al. | 72/302 |
| 3,168,777 | 2/1965 | De Ridder et al. | 29/157.3 R |
| 3,204,325 | 9/1965 | Ernestus | 29/155 |
| 3,436,948 | 4/1969 | Portal et al. | 29/157.3 R |
| 3,545,242 | 12/1970 | Dean | 72/183 |

FOREIGN PATENT DOCUMENTS

| | | | |
|---|---|---|---|
| 1452261 | 2/1969 | Fed. Rep. of Germany | 72/253 |
| 1452957 | 4/1971 | Fed. Rep. of Germany | 72/302 |

*Primary Examiner*—Francis S. Husar
*Assistant Examiner*—D. M. Gurley
*Attorney, Agent, or Firm*—Ralph L. Cadwallader; Leo M. Kelly

[57] ABSTRACT

A method of manufacturing a high fin density heat dissipator is disclosed in which the dissipator is extruded through a die in a partially cylindrical shape with the elongated fins arranged on the base and extending radially therefrom. The extruded dissipator is straightened under tensile and bumping forces in a manner such that the base assumes a planar shape and the fins become substantially parallel to each other. Apparatus for straightening the extruded dissipator and a die for extruding the same are illustrated and described.

6 Claims, 16 Drawing Figures

METHOD AND APPARATUS FOR PRODUCING A HIGH FIN DENSITY EXTRUDED HEAT DISSIPATOR

RELATED APPLICATION

This application is a continuation-in-part of U.S. application Ser. No. 790,621 filed Apr. 25, 1977, now abandoned.

SUMMARY OF THE INVENTION

The present invention relates to heat dissipators used with electronic components and, more particularly, to a process for manufacturing a high fin density extruded heat dissipator and to apparatus and a die used in its manufacture.

A patentability search produced the following references copies of which were furnished with said U.S. application Ser. No. 790,621:

| U.S. Pat. No. | Inventor |
|---|---|
| 1,423,361 | A. F. Rockwell |
| 2,458,686 | R. P. Davie |
| 2,716,805 | M. S. Reed |
| 3,168,777 | E. J. DeRidder et al |
| 3,204,325 | A. W. Ernestus |
| 3,436,948 | P. Portal et al |

The patents to Rockwell, Davie and Reed teach extrusion of cylindrical bodies having integral ribs, splitting the cylinders and flattening them. The patent to DeRidder et al teaches extrusion of a cylindrical transformer casing having exterior ribs used for cooling purposes. The patents to Ernestus and Portal et al teach processes for forming cylindrical bodies from work pieces by radial extrusion using complicated dies and rollers. Ernestus also teaches splitting the cylindrical bodies and flattening them to produce reinforced planar panels.

A number of heat dissipators used with electronic components operating at moderate power levels are normally made from aluminum extrusions because the extrusion process provides a large amount of surface area in the shape of fins at low cost. Such extrusions can be specifically designed to meet particular performance or configuration requirements. Heretofore the number of fins that could be placed next to each other within a specific space has been limited by the structural limitations of the die that shapes the metal forced through it into the desired configuration. The extrusion process generates large stress loadings on the die fingers, which may be considered to be cantilever beams, that form the open spaces between the fins in the finished heat dissipator. Heretofore when the number of fins was increased within a specific space, the thickness of the die fingers was reduced at the base and the die fingers became weaker and more likely to break off when subjected to the stress loadings imposed during the extrusion process.

Therefore, in order to obtain a greater number of fins within a specific space, or a higher fin density, the usual method was to fabricate the heat dissipator from separate component parts. In this method the fins are made independently and are soldered, brazed or staked to a suitable base. The obvious drawback to this method is the cost of additional labor and machine time required to assemble the finished dissipator compared to an extruded dissipator. In some applications this factor can be accepted to obtain the improved ability of the higher fin density heat dissipator to dissipate much larger amounts of heat, especially in forced convection situations.

To eliminate the above disadvantages of the prior art, the present invention contemplates extruding an integral, one-piece, heat dissipator in a partially cylindrical shape with the elongated fins arranged on the base and extending radially therefrom and then straightening the extruded heat dissipator in a manner such that the base assumes a planar shape and the fins become substantially parallel to each other. It is an objective of the invention to provide an extruded heat dissipator having a higher fin density than heretofore in the prior art. A further objective is to provide a die for use in extruding the novel heat dissipator in which the strength of the die fingers is substantially increased. An additional objective is to provide apparatus for straightening the extruded heat dissipator.

In a preferred embodiment of the invention, an extrusion die has a partially circular interior cross-section. The die fingers project inwardly from the circular outer perimeter of the interior and terminate on a parallel interior circumference. The die fingers are solid from the outer circular perimeter to their tips. Further, the die is designed to provide means whereby the extruded part can be gripped at each end. The extruded heat dissipator is placed about a mandrel and one end of the base is secured to the mandrel. The other end of the base is secured to a means for applying a pulling force, resulting in a specific tensile stress to the base in a plane tangent to the mandrel. A brake is applied to the mandrel and when the predetermined specific tensile stress at the line of tangency is reached the mandrel rotates and the heat dissipator straightens at the line of tangency. After the base has been straightened, a final tensile stress, slightly exceeding the yield point, is applied to further strain straighten the heat dissipator. The base is now straight as a result of the applied tension. If this tension is released, the base fibers which were adjacent to the mandrel will elastically contract the most because they were strained to a higher yield strength than the base fibers which were farthest from the mandrel. This results in the base assuming a slightly curved shape when tension is released. If a momentary controlled bumping force is applied to the base during the application of this final tensile stress, directly or through the fins and perpendicular to the base, it will further strain the fibers which were closest to the mandrel and cause the base to become substantially flat and straight upon release of the tensile stress.

Further objects and advantages will appear to those skilled in the art as the description proceeds in connection with the accompanying drawings.

DETAILED DESCRIPTION

Figure 1:
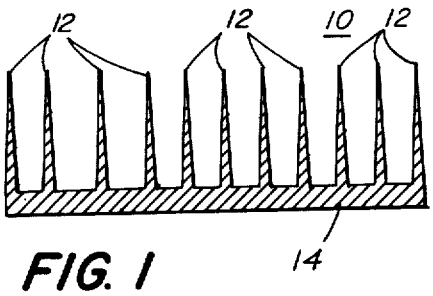
FIG. 1 (PRIOR ART)
FIG. 1 illustrates in a sectional view a typical prior art extrusion used as a heat dissipator for electronic components.

FIG. 1 illustrates a prior art heat dissipator 10 having a plurality of fins 12 integral with base 14. The large surface area presented by the plurality of fins 12 enables dissipator 10 to dissipate large amounts of heat produced by electronic components, not shown, that are affixed to base 14. Dissipator 10 is made of aluminum extruded through a die having a cross-section similar to that of die 16 in FIG. 2 which has fingers 18. Die 16 can be used to extrude dissipator 20 of FIG. 3 which has a plurality of fins $22_1$, $22_2$, $22_3$, $22_4$ and base 24.

Figure 3:
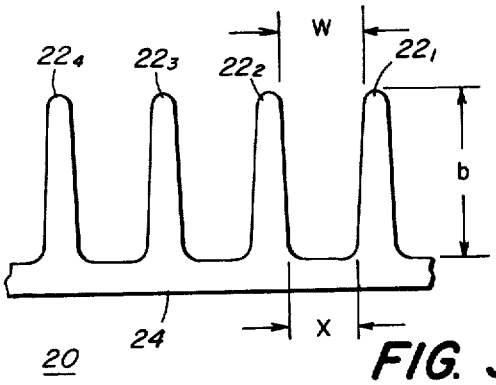
FIG. 3 (PRIOR ART)
FIG. 3 illustrates in an end view a portion of a prior art finned heat dissipator used in defining the term "Fin Ratio"

The art of producing aluminum extrusions for use as heat dissipators is sufficiently versatile to result in a number of differently dimensioned dissipators of varying lengths and having fins of various heights. However, as stated above, there are limits on the stress loadings that can be applied to the die fingers such as die fingers 18 in FIG. 2. Thus there is a limit to the number of fins (or fin density) that can be placed within a given space on the base of an extruded heat dissipator. A measure of this limit may be called the Fin Ratio which we define as the ratio of the cross-sectional area of the space between the fins divided by the square of the width of the gap at the tips of the fins. Thus:

$$\text{Fin Ratio} = \text{AREA}/\text{GAP}^2 = (w+x)b/2w^2$$

where in FIG. 3 w = the width of the gap between the tips of fins $22_1$ and $22_2$;

x = the width of the gap between fins $22_1$ and $22_2$ at base 24; and b = the height of fins $22_1$ and $22_2$ The Fin Ratio is based on the structural limitations of the die that shapes the metal forced through it into the desired configuration. The extrusion process generates large stress loadings on the die fingers which form the open spaces between the fins in the extrusion. The die fingers can be considered to be cantilever beams and the Fin Ratio constitutes a measure of the strength of these cantilever beams. Thus, the higher the value of the Fin Ratio, the weaker and more likely to break off will be the die fingers.

Figure 2:
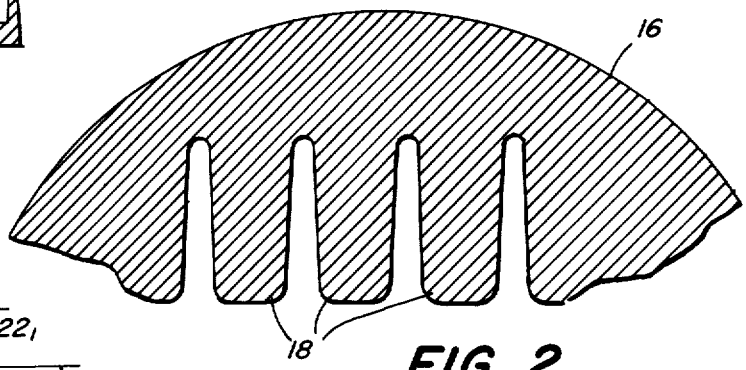
FIG. 2 (PRIOR ART)
FIG. 2 shows in a sectional view part of a prior art die used to extrude a heat dissipator of the form shown in FIG. 3.

This will be apparent upon consideration of FIGS. 2 and 3. If the number of fins $22_n$ is tripled within the same space and their height b is doubled, it will be obvious that fingers 18 will be long and thin at their base with a much greater likelihood of breaking off during the extrusion operation. In most prior art applications Fin Ratios of 4.0 have been readily achieved and, in certain circumstances, Fin Ratios of 6.0 have been successful.

Figure 4:
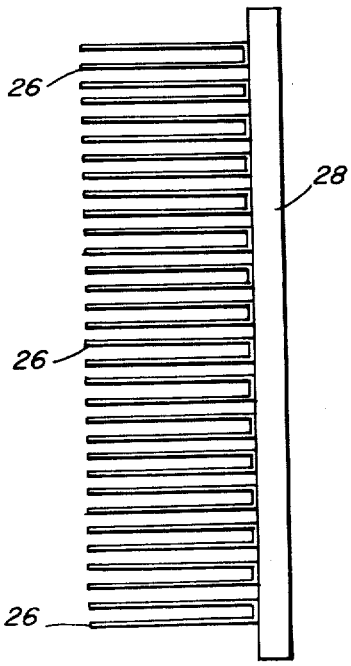
FIG. 4 (PRIOR ART)
FIGS. 4 and 5 illustrate prior art heat dissipators having soldered fins and staked fins respectively.
Figure 5:
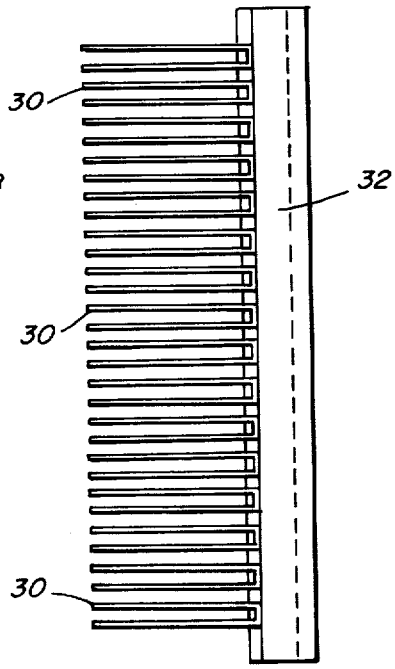
FIG. 5 (PRIOR ART)

To obtain higher fin densities, with the resultant higher Fin Ratios, the usual method is to fabricate the heat dissipator from separate components. Typical designs are shown in FIGS. 4 and 5. In FIG. 4, U-shaped fins 26 are soldered to base 28 whereas in FIG. 5 separate U-shaped fins 30 are staked to base 32.

Figure 6:
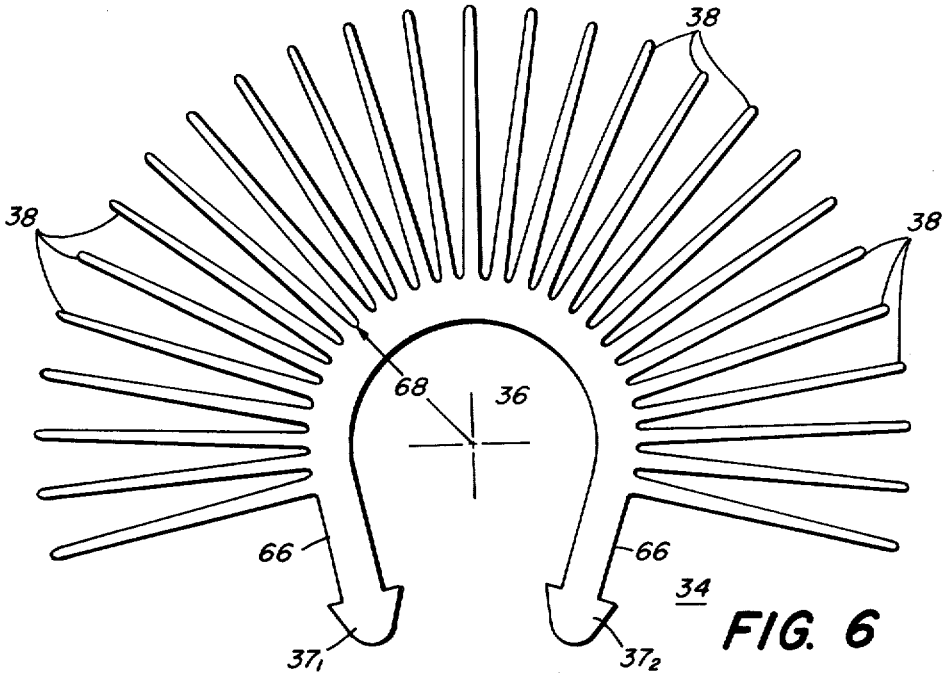
FIG. 6 illustrates an end view of an extrusion made with the die of FIG. 7.
Figure 7:
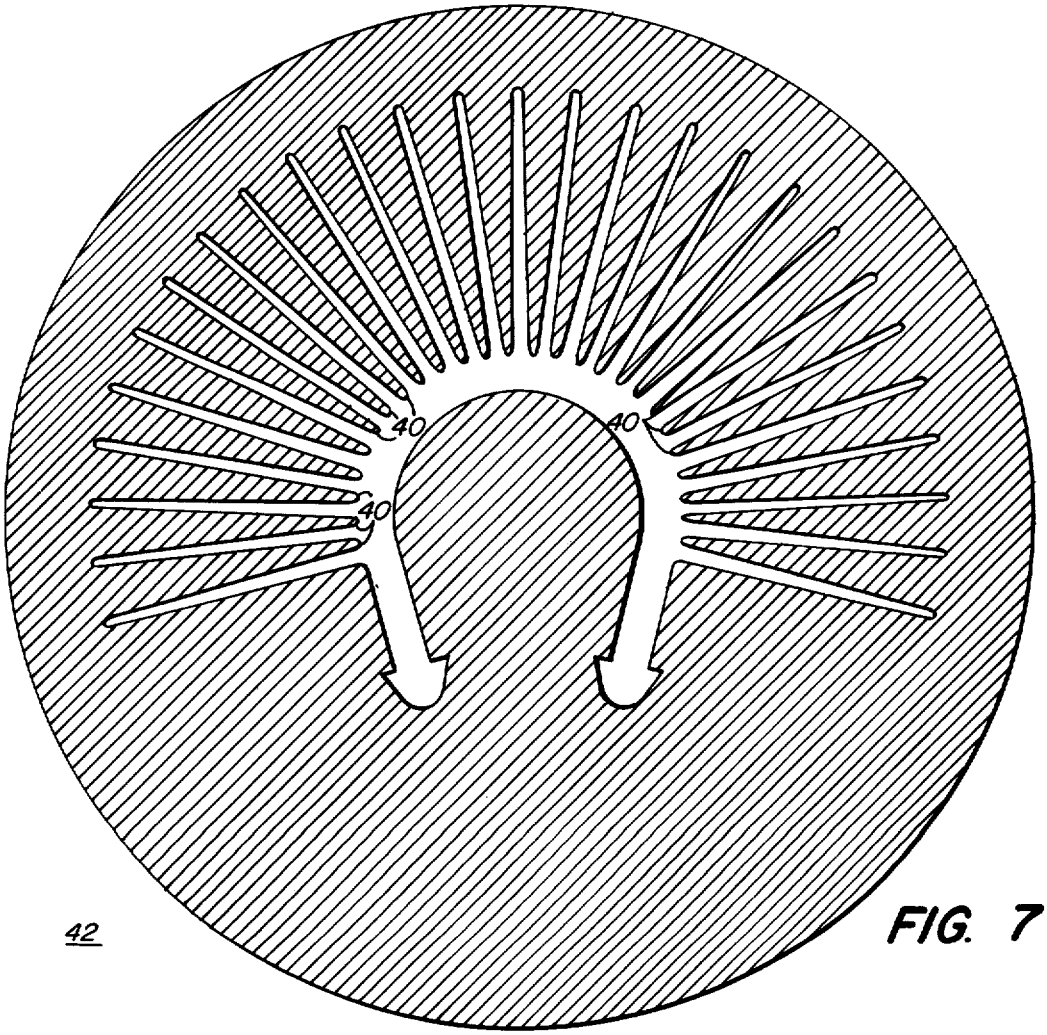
FIG. 7 shows in a sectional view a die used in the practice of the present invention.

FIG. 6 illustrates extrusion 34 made by extruding aluminum through die 42 of FIG. 7 in accordance with the present invention. Extrusion 34 has a partially circular base 36 and a plurality of fins 38 extending radially therefrom. Note that fins 38 are of equal height. Two or more fin heights may be utilized in such an extrusion, depending upon design requirements. The primary advantage of the shape of extrusion 34 is that the physical spacing between fin tips is increased which in turn decreases Fin Ratio and improves the strength of die fingers 40 of die 42 of FIG. 7. This will be apparent upon consideration of the wide bases of die fingers 40 and their triangular cross-sectional shapes. Note the close spacing of fins 38 near base 36.

The ends of base 36 of extrusion 34 have male grippers $37_1$ and $37_2$. Male gripper $37_1$ slides into female gripper 44 machined in mandrel 46 of FIG. 8 as shown. Female gripper 48 slides over male gripper $37_2$ as shown. Female gripper 48 is connected to device 50 that exerts a straight tangential motion away from mandrel 46. It will be understood that other means than herein shown may be used to grip the ends of base 36 of extrusion 34. Device 50 may be any mechanism that exerts a pulling force such as, for example, a hydraulic cylinder, a pneumatic system or a screw jack arrangement. Brake drum 52 is set to restrain rotation of mandrel 46 until a sufficient bending moment is applied to base 36 at a line of tangency 54 with mandrel 46 which causes base 36 to straighten substantially at the line of tangency. Mandrel 46 then begins to rotate as long as the bending moment is applied and the straightening becomes progressive as mandrel 46 rotates. This is due to the fact that straight portion 56 of base 36 can be considered as a cantilever member at tangent line 54, with a maximum stress occuring at the same line. So, as extrusion 34 is progressively pulled by female gripper 48 away from mandrel 46, it will assume substantially the configuration illustrated in FIG. 9, at which point mandrel 46 is caused to stop rotating, either by means of brake 52 or by means of any one of a variety of mechanical stops that are well known in the art, such as here illustrated schematically at 53.

Figure 10:
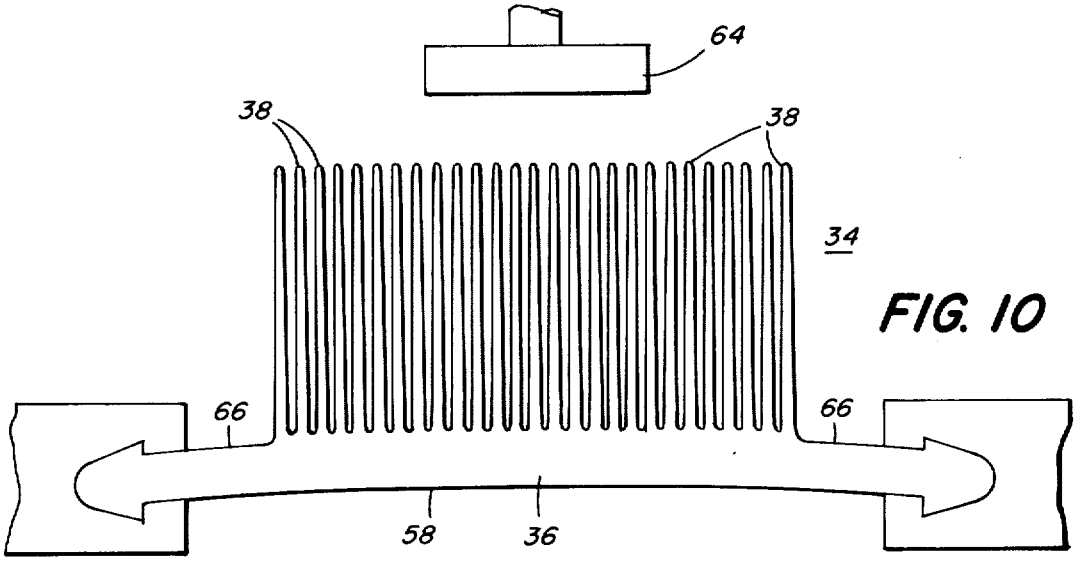
FIG. 10 schematically illustrates the shape that the extrusion of FIG. 6 will take after tensile force is removed without application of a bumping force.

FIG. 10 schematically illustrates, in somewhat exaggerated form for purposes of explanation, the shape that base 36 will take if the tensile force is now released. The base fibers near surface 58 of base 36 having been strained to a higher yield strength than the base fibers which resided farthest from surface 58, will elastically contract the most, resulting in the base 36 assuma slightly curved shape as illustrated. If extrusion 34 were now removed, surface 58 would have to be machined to make it flat. This situation is avoided by applying a bumping force against base 36 through fins 38 with bumper 64, which may be operated by any system that can be arranged to apply a striking force, such as a hydraulic system.

Figure 9:
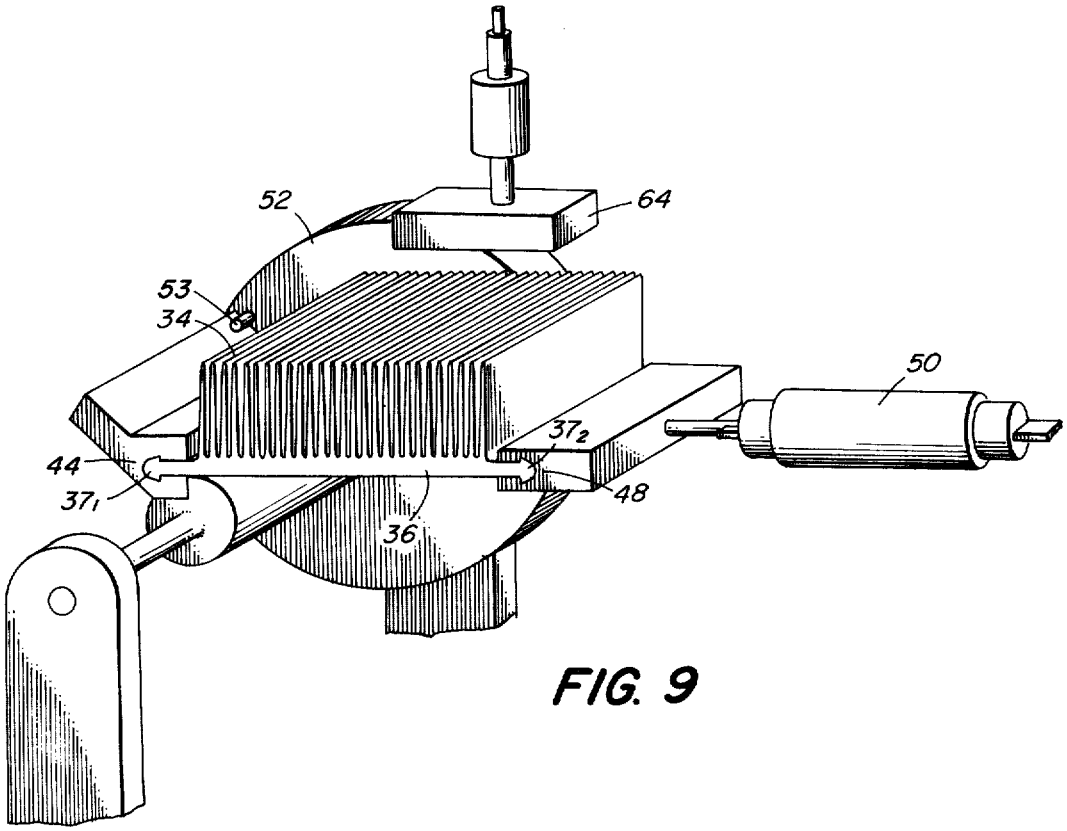
FIG. 9 illustrates straightening of the extrusion of FIG. 6 prior to application of the bumping force.
Figure 11:
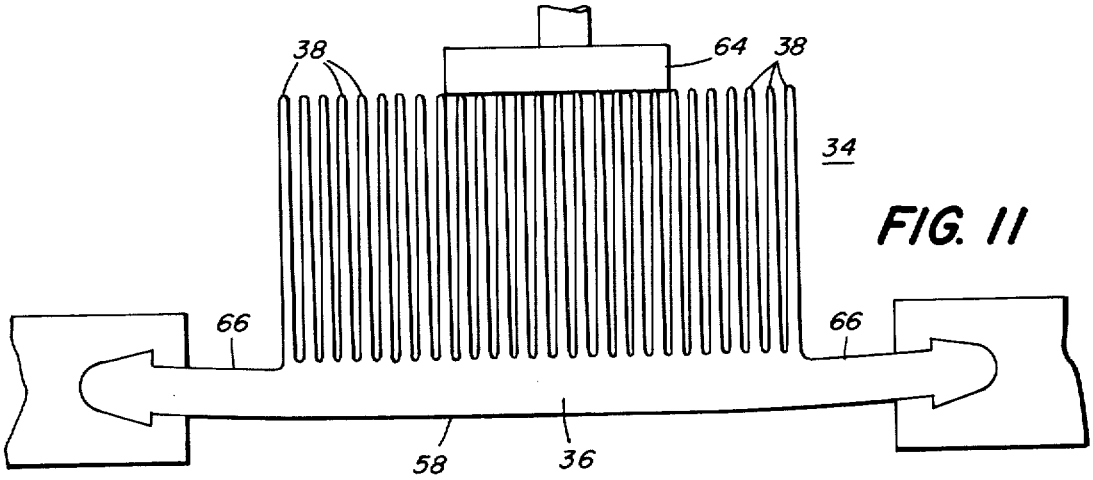
FIG. 11 schematically illustrates the condition of the extrusion of FIG. 6 during application of the bumping force.

Referring to FIGS. 9 and 11 when mandrel 46 stops rotating and extrusion 34 is completely extended, a final tensile stress, in excess of the base metal yield point, is applied to elongate base 36 by approximately 1% and concurrently bumper 64 is caused to strike the base through the tips of fins 38 a momentary blow. Surface 58 bows slightly in the opposite direction as illustrated in FIG. 11. Additional straining of the outermost fibers nearest surface 58 in base 36 occurs which tends to compensate against the higher elastic contraction of the outermost fibers. After release of the bumping and tensile forces base 36 assumes the substantial flat shape illustrated in FIG. 12. Surface 58 is substantially flat, requiring no machining. Extrusion 34 can now be removed from the machine and male grippers $37_1$ and $37_2$ are removed to provide the finished high fin density heat dissipator.

Figure 12:
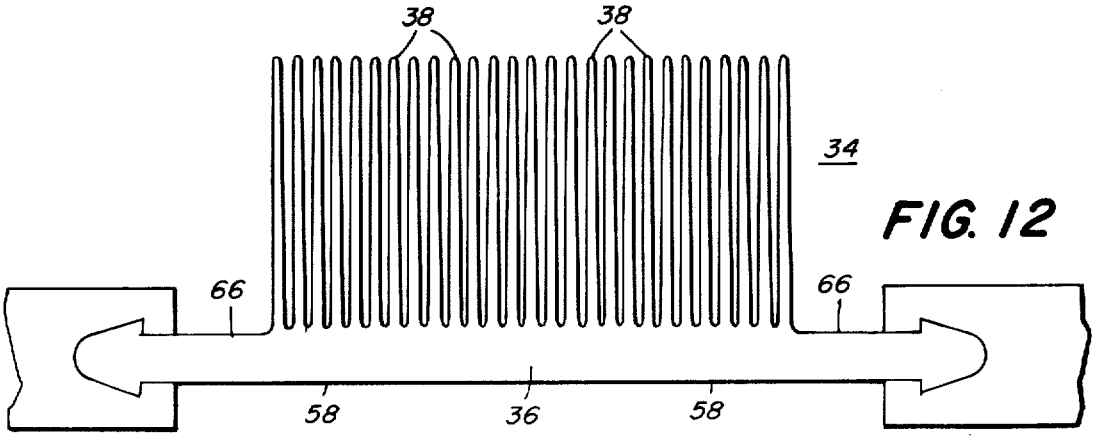
FIG. 12 schematically shows the extrusion of FIG. 6 after removal of all forces.

An important aspect of the invention is that fins 38 of extrusion 34 are not subjected to the tensile force exerted by device 50 upon base 36 because they represent discontinuous projections on outside surface 66 of base 36. As a result fins 38 remain in an unchanged positional attitude with respect to surface 66 as base 36 is straightened. So fins 38, which start out on extrusion 34 looking like spokes of a wheel with a low Fin Ratio, end up as parallel fins on a heat dissipator with a very high Fin Ratio. The actual centerline to centerline dimension between adjacent fins 38 in FIG. 12 is controlled by their angular spacing in FIG. 6, radius 68 to base surface 66 and the amount of final strain straightening and bumping of base 36.

Figure 13:
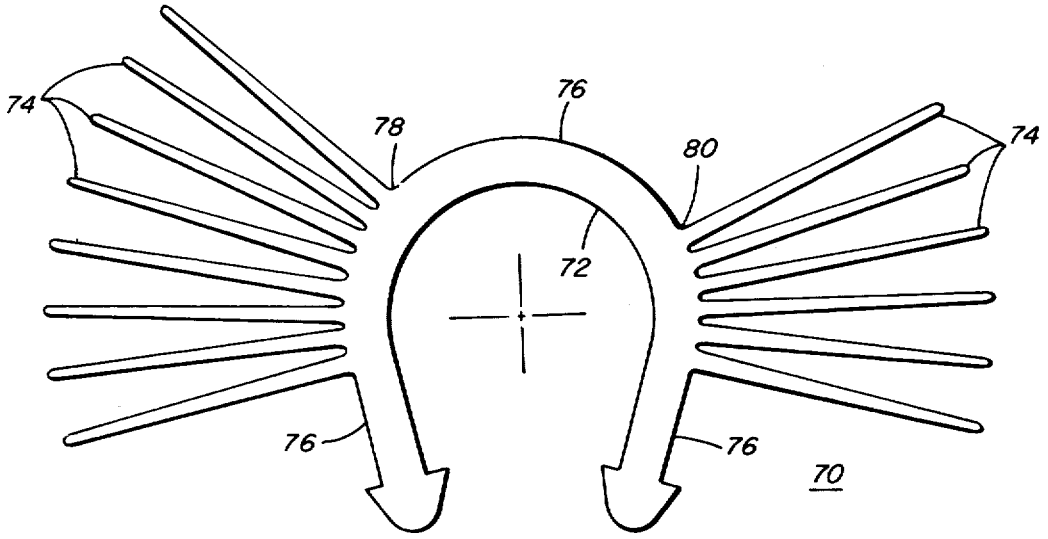
FIG. 13 illustrates an end view of an alternative extrusion made according to the present invention.
Figure 15:
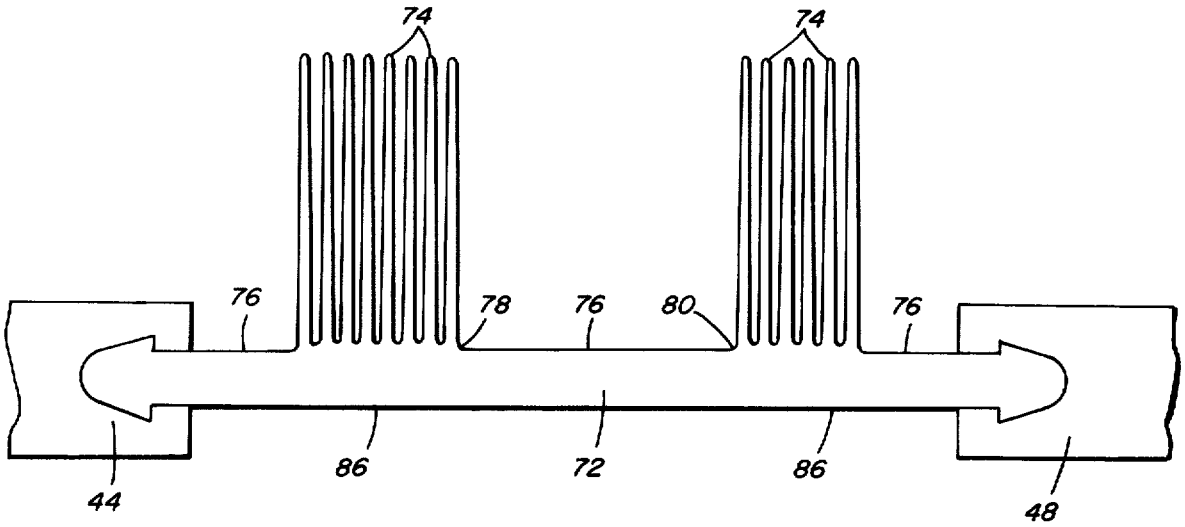
FIG. 15 schematically shows the extrusion of FIG. 13 after removal of all forces.

FIG. 13 illustrates extrusion 70 made in accordance with the present invention. Extrusion 70 likewise has a partially circular base 72 and a plurality of fins 74. Note that no fins extend from surface 76 between points 78 and 80. Referring, for a moment, to FIG. 15, it is intended that electronic components, not shown, be mounted on surface 76 between points 78 and 80.

Figure 8:
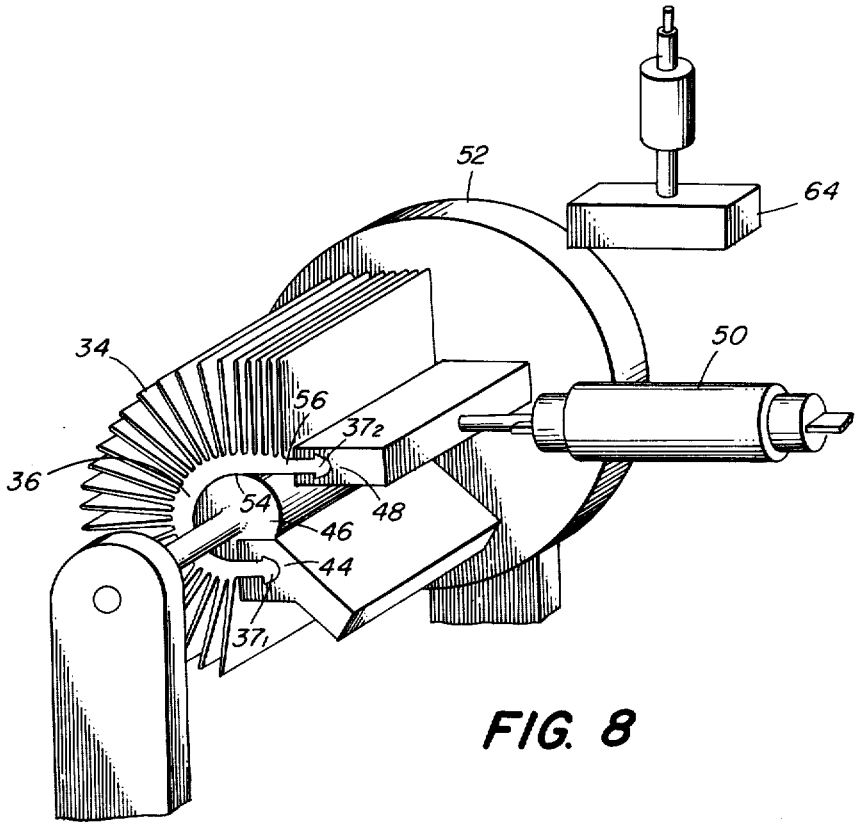
FIG. 8 schematically illustrates apparatus used to straighten the extrusion of FIG. 6.
Figure 14:
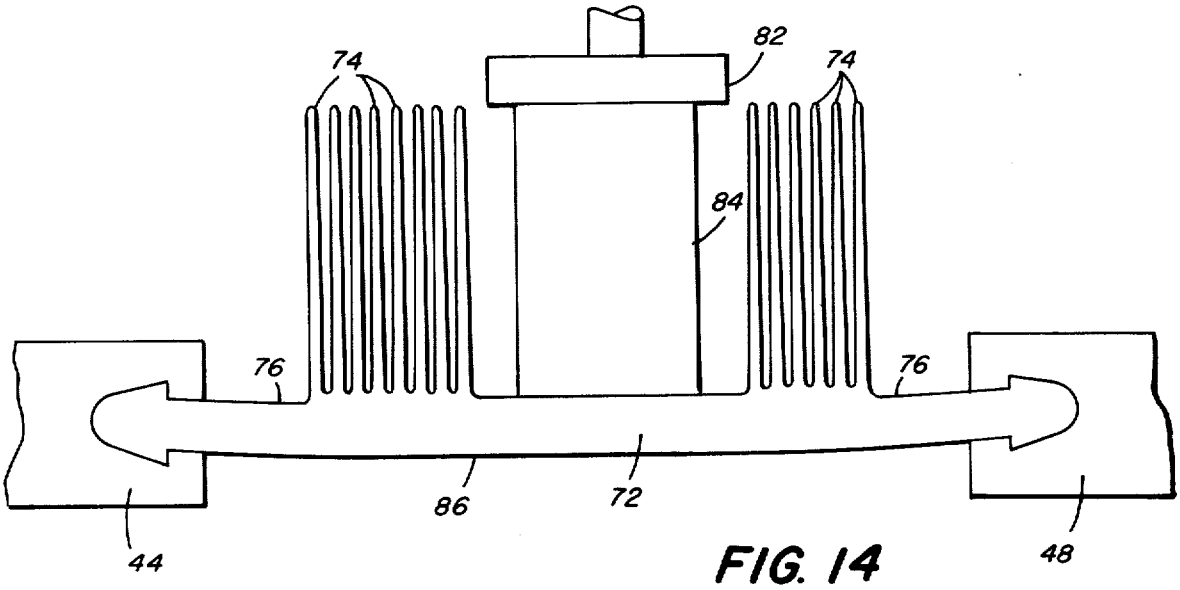
FIG. 14 schematically illustrates application of the bumping force while maintaining tensile stress upon the extrusion of FIG. 13.

Extrusion 70 is placed in apparatus similar to that of FIGS. 8 and 9 and a similar method of straightening is applied. In this case, however, referring to FIG. 14, bumper 82 has bumper extension 84 affixed to it. While the final tensile stress is applied, bumper 82 and bumper extension 84 apply a bumping force directly to base 72. Surface 86 bows in the direction illustrated in FIG. 14. After release of the bumping and tensile forces base 72 assumes the substantial flat shape illustrated in FIG. 15. Surface 86 is substantially flat, requiring no machining.

Figure 16:
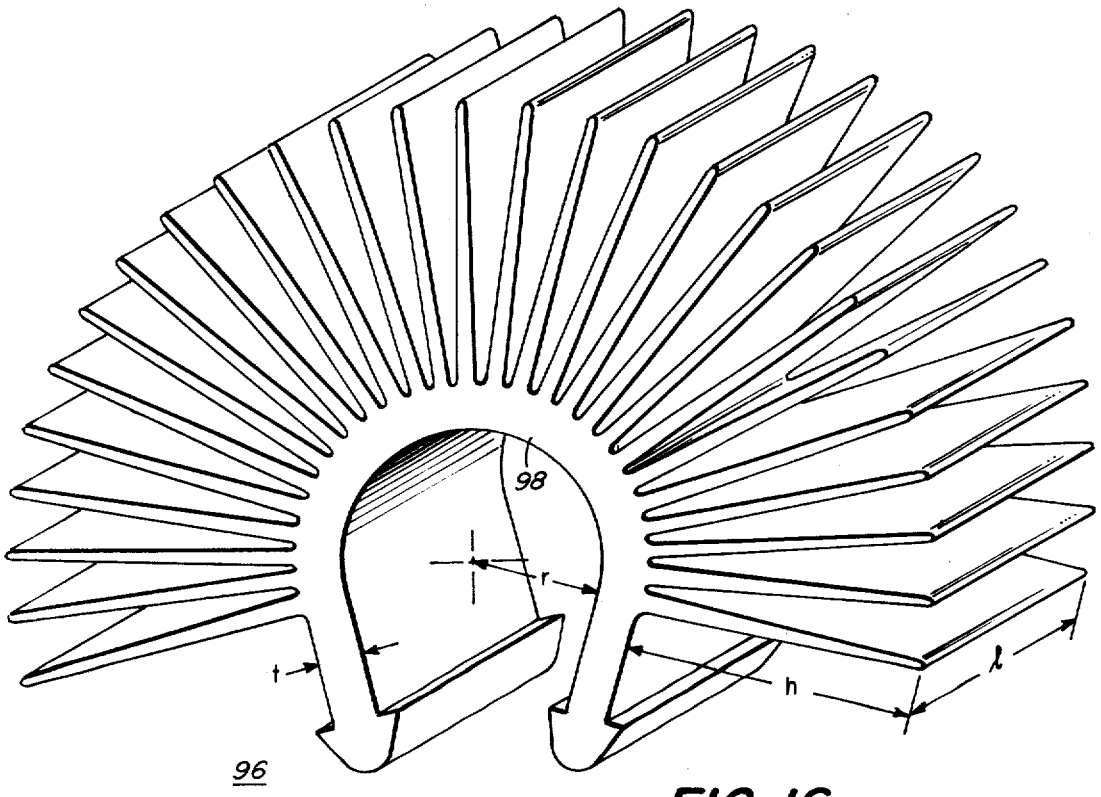
FIG. 16 presents in a perspective view an extrusion made in production quantities for the purpose of describing an example.

FIG. 16 illustrates extrusion 96 made in production quantities with a die such as that illustrated in FIG. 7 and straightened by the method of the present invention. Extrusion 96 has base 98 which is partially cylindrically shaped, with an inner radius, r, of 1.7 inches; a base thickness, t, of 0.20 inch; a fin height, h, of 2.9 inches; and a fin length, 1, of 12 inches. The fins are 0.08 inch thick near the base and 0.07 inch thick near their tips. The fins are spaced radially about the base at regular angular intervals of 11°. This configuration results in a Fin Ratio of 2.23 for extrusion 96. Extrusion 96 is easily extruded in 6063 alloy aluminum. It is heat treated to T5 temper before straightening.

Extrusions 96 have been straightened in production quantities by applying an initial pulling force of 4 tons for about 8 seconds and a final pulling force of 32 tons for about 6 seconds together with a bumping force of one ton applied in about 2 seconds. This results in a final pulling stress of 27,000 psi which is at the high end of material specifications. It should be noted that necking along fin bases is restricted by the fins and base thickness only necks down during yield, substantially increasing apparent yield strength values.

The primary advantage of heat dissipators made according to the present invention is that they have high Fin Ratios on the order of 10 to 15 compared to prior art extruded heat dissipators having the finned construction. Compared to heat dissipators having soldered or staked fins, dissipators made according to the present invention will not disassemble or fail when subjected to stress or vibration and enable the realization of significant savings in costs of fabrication and labor.

The examples described above have of course been given solely by way of explanatory illustration and it must be understood that the scope of the invention extends to all alternative forms of all or a part of the arrangements heretofore described and which remain within the definition of equivalent mechanical means.

We claim:

1. The method of manufacturing an integral heat dissipator having high density fins extending from a surface of a base comprising:

extruding the integral heat dissipator with a partial cylindrical base having the fins extending substantially radially from the outer cylindrical surface of the base;

placing the said extruded heat dissipator about a mandrel;

securing one end of the base to the mandrel;

securing the other end of the base to a means for applying a tensile stress to the base in a plane tangent to the mandrel at a line of tangency;

braking rotation of the mandrel while applying the tensile stress to rotate the mandrel thereby gradually straightening the dissipator;

after the base has been substantially straightened stopping further rotation of the mandrel; and increasing said tensile stress to a value slightly above the yield point to further strain straighten the base of the heat dissipator.

2. The method of claim 1 further comprising the additional step of applying a momentary bumping force against the base in a direction perpendicular to the base while said increased tensile stress is applied.

3. The method of claim 2 in which the bumping force is applied to the base through the fins.

4. The method of claim 2 in which the bumping force is applied directly to the base.

5. Apparatus for straightening an extruded heat dissipator having a partially cylindrically shaped base with fins extending radially from the outer surface of the base, comprising:

a mandrel having means to grip one end of the base of the heat dissipator;

means for gripping the other end of the base and for applying a pulling force to the base in a plane tangent to the mandrel at a line of tangency, thereby applying a bending moment to the base at the line of tangency;

a brake arranged to prevent rotation of the mandrel until stresses resulting from said bending moment exceed the yield strength of the base at the line of tangency;

means to stop rotation of the mandrel after the base has been substantially straightened; and means to further stretch the base by increasing the pulling force slightly above the yield point of the base to further strain straighten the base of the heat dissipator.

6. Apparatus as in claim 5 further comprising means for applying a momentary bumping force to the base in a direction perpendicular to the base while the base is being stretched further.

* * * * *